United States Patent [19]

Takahashi

[11] 4,290,194

[45] Sep. 22, 1981

[54] APPARATUS FOR INTERENGAGING OPPOSED ROWS OF SLIDE FASTENER COUPLING ELEMENTS

[75] Inventor: Kihei Takahashi, Uozu, Japan

[73] Assignee: Yoshida Kogyo K. K., Tokyo, Japan

[21] Appl. No.: 90,136

[22] Filed: Nov. 1, 1979

[30] Foreign Application Priority Data

Nov. 6, 1978 [JP] Japan ..... 53-136551

[51] Int. Cl.[3] ..... B23P 11/00; B23P 19/04; B29D 5/00

[52] U.S. Cl. ..... 29/766

[58] Field of Search ..... 29/33.2, 408, 410, 428, 29/766, 769

[56] References Cited

U.S. PATENT DOCUMENTS

| | | | |
|---|---|---|---|
| 2,613,433 | 10/1952 | Rojahn | 29/766 |
| 3,478,404 | 11/1969 | Plummer | 29/766 X |
| 3,703,026 | 11/1972 | Uhrig | 29/766 X |
| 3,750,260 | 8/1973 | Jakob | 29/766 X |

*Primary Examiner*—Ervin M. Combs

*Attorney, Agent, or Firm*—Hill, Van Santen, Steadman, Chiara & Simpson

[57] ABSTRACT

An apparatus for mating a pair of slide fastener coupling elements carried on a pair of stringer tapes, respectively, includes a pair of guide wheels each having a plurality of peripheral teeth meshable with one of unengaged rows of coupling elements for guiding the same and for regulating distances between adjacent coupling elements of each row, and a pair of presser rollers for squeezing the unengaged rows of coupling elements to interengage the same immediately after the latter are released from the teeth of the guide wheels. The axis of each guide wheel is eccentric to that of one of the presser rollers. With this arrangement, the pair of rows of coupling elements can be mated nicely without obstruction or impairment by wheel teeth but while such regulated distances between adjacent coupling elements of each row remain.

4 Claims, 6 Drawing Figures

APPARATUS FOR INTERENGAGING OPPOSED ROWS OF SLIDE FASTENER COUPLING ELEMENTS

BACKGROUND OF THE INVENTION

1. Field of the Invention

The present invention relates to an apparatus for interengaging or mating a pair of rows of slide fastener coupling elements carried on a pair of stringer tapes, respectively.

2. Prior Art

To interengage a pair of rows of slide fastener coupling elements carried on a pair of stringer tapes, respectively, it has been known to press unengaged rows of coupling elements against each other solely by use of a pair of presser rollers. A common drawback encountered with such prior art is that the individual coupling elements on the stringer tapes are liable to objectionably slant and thus often end up with irregular element-to-element distance or pitch.

Attempts have been made to solve the above problem. To this end, it has been proposed to utilize a pair of toothed wheels each disposed concentrically of one of the presser rollers, the teeth of each wheel being meshable with one of the rows of coupling elements. However, with this arrangement, the individual coupling elements would be easily impaired by the teeth of the wheels and smooth and accurate mating of the opposed rows of coupling elements is difficult to achieve.

SUMMARY OF THE INVENTION

An apparatus according to the present invention includes a pair of radially spaced toothed wheels for guiding therebetween unengaged rows of slide fastener coupling elements and for regulating distances between adjacent coupling elements of each of the unengaged rows, and a pair of radially spaced presser rollers for pressing or squeezing therebetween the pair of rows of coupling elements to interengage the same. The axis of each toothed wheel is eccentric to that of a corresponding one of the presser rollers, so that the pair of rows of coupling elements can be interengaged immediately after the same are removed from the toothed wheels. With this arrangement, the pair of rows of coupling elements can be mated without obstruction by the teeth of the wheels but while such regulated distances between adjacent coupling elements of each row remain.

It is therefore an object of the invention to provide a coupling-elements pairing apparatus which enables a pair of rows of slide fastener coupling elements to be mated nicely with maximum ease and with minimum cost.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF THE PREFERRED EMBODIMENT

Figure 1:
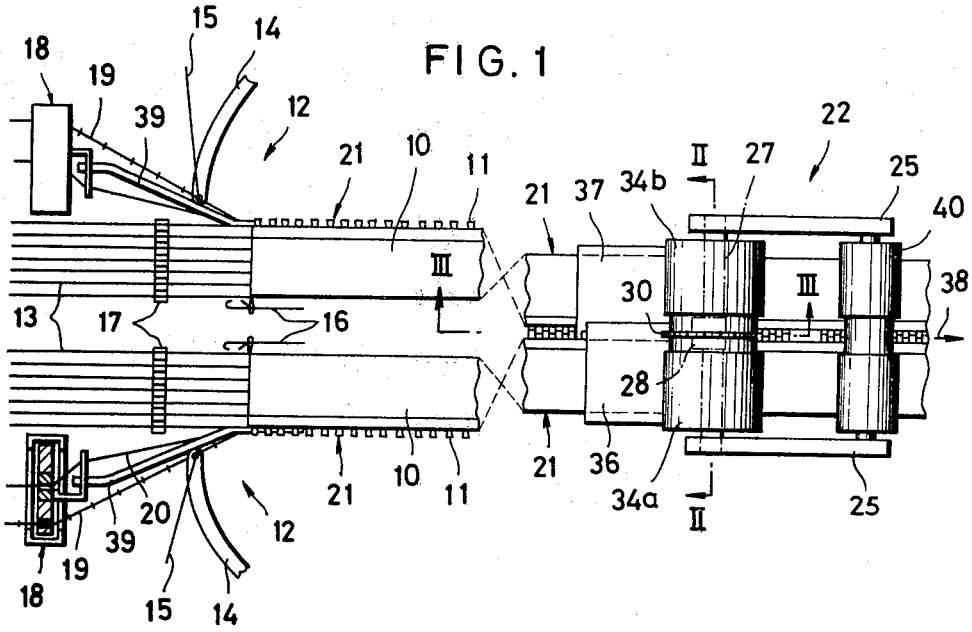
FIG. 1 is a plan view of a pairing apparatus embodying the present invention, with a loom for simultaneously producing two slide fastener stringers to be paired by the apparatus.

As shown in FIG. 1, a pair of woven slide fastener stringer tapes 10,10 each carrying a row of coupling elements 11 woven thereinto are simultaneously manufactured with a weaving machine of a known construction which includes a pair of needle looms 12,12. Each needle loom 12 essentially comprises a plurality of harnesses (not shown) for forming sheds of warp threads 13, a filling carrier 14 for inserting a weft threads 15 across the warp shed, a latch needle 16 for catching and knitting the weft thread 15 in the warp shed to form a selvedge along one longitudinal edge of one of the stringer tapes 10, and a reed 17 for beating the weft thread 15 in the warp shed into the fell of the tape 10. The needle loom 12 further includes a coiling rotor assembly 18 for supplying a monofilament 19 and a core thread 20 and for coiling the monofilament 19 around a mandrel 39 to provide the row of coupling elements 11 along the other longitudinal tape edge remote from the selvedge. Thus, a pair of slide fastener stringers 21,21 have been provided in which the pair of stringer tapes 10,10 carry the pair of rows of coupling elements 11,11 along respective outer longitudinal tape edges.

The pair of slide fastener stringers 21,21 thus provided are introduced into a pairing apparatus 22 embodying the present invention, after having been put upside down, i.e. each twisted 180°, by a suitable means (not shown) such that the pair of rows of coupling elements 11,11 are opposed to each other. In the pairing apparatus 22, the opposed rows of coupling elements 11,11 are interengaged or mated in the manner described below.

Figure 2:
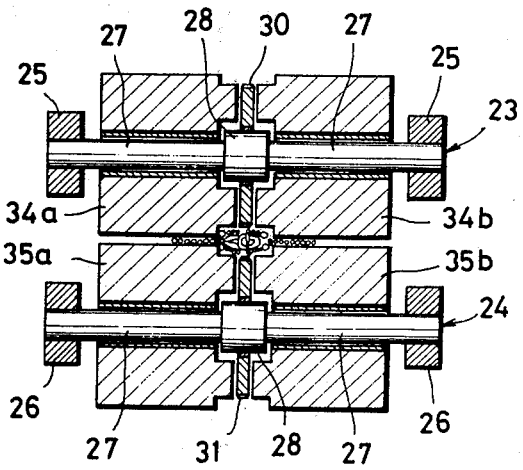
FIG. 2 is an enlarged cross-sectional view taken along line II—II of FIG. 1.

As best shown in FIG. 2, the pairing apparatus 22 includes a pair of parallel spaced upper and lower shafts 23,24 each non-rotatably fixed at opposite ends to a pair of support plates 25,25 and 26,26, all of which are in turn fixed to a base (not shown). Each of the upper and lower shafts 23,24 has a pair of axially spaced first portions 27,27 of small diameter and a second portion 28 of large diameter, the second portion 28 being disposed between the two first portions 27,27.

The pairing apparatus 22 further includes a pair of upper and lower guide wheels 30,31 rotatably mounted on the second portions 28,28 of the upper and lower shafts 23,24 respectively. The upper and lower guide wheels 30,31 are radially spaced a predetermined distance from each other for guiding therebetween the pair of rows of coupling elements 11,11 to be mated. Each guide wheel 30,31 has a plurality of peripheral teeth 32,33 (FIG. 3) engageable or meshable with one of the pair of rows of coupling elements 11,11 for regulating distances between adjacent coupling elements of each row.

A pair of upper and lower presser rollers 34,35 (FIG. 3) are rotatably mounted on the small diameter (first) portions 27,27 of the upper and lower shafts 23,24, respectively. Each of the upper and lower presser rollers 34, 35 includes a pair of roller sections 34*a*,34*b* and 35*a*,35*b* (FIG. 2) disposed one on each side of the guide wheel 30,31 on one of the upper and lower shafts 23,24. The upper and lower presser rollers 34,35 are radially spaced from each other for pressing or squeezing the opposed pair of slide fastener stringers 21,21 therebetween to interengage the pair of rows of coupling elements 11,11. As the pair of slide fastener stringers 21,21 are thus paired, they are squeezed by the mating roller sections 34*a*,35*a* and by the mating roller sections 34*b*,35*b*, resepctively.

Figure 5:
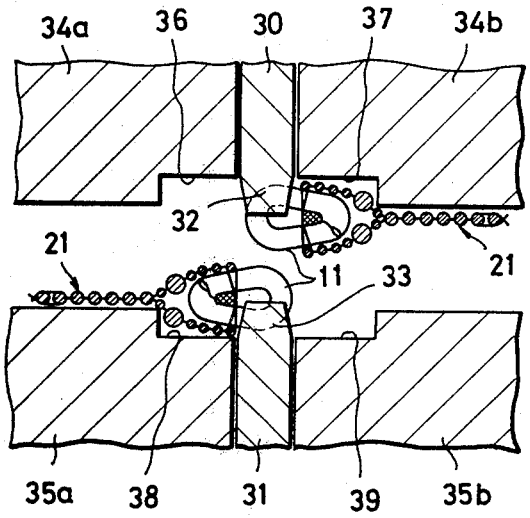
FIG. 5 is an enlarged cross-sectional view taken along line V—V of FIG. 3.
Figure 6:
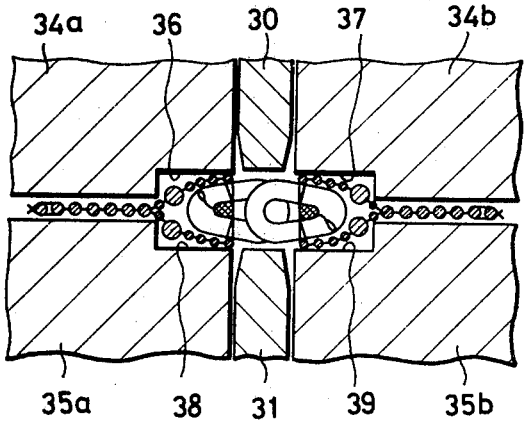
FIG. 6 is an enlarged cross-sectional view taken along line VI—VI of FIG. 3.

Each of the four roller sections 34*a*,34*b*,35*a*,35*b* (FIG. 2) has a recessed portion 36,37,38,39 (FIGS. 5 and 6) extending along an inner peripheral edge thereof for guiding and receiving a portion of one of the pair of rows of coupling elements 11,11; that is, such four recessed portions 36–39 jointly define between the upper and lower presser rollers 34,35 a passage of substantially rectangular cross section for the pair of rows of coupling elements 11,11, as best shown in FIG. 6.

The large diameter (second) portion 28 (FIG. 3) of each shaft 23,24 is horizontally eccentric to the small diameter (first) portions of the same shaft. In other words, as more clearly shown in FIG. 4, the axis 01,02 of each guide wheel 30,31 is spaced a first distance r from the axis P1,P2 of one of the presser rollers 34,35 toward the inlet side (left side as viewed in FIG. 3) of the pairing apparatus 22. Accordingly, the pair of rows of coupling elements 11,11, when located at the point M, are spaced a second distance H1,H2 from the upper and lower guide wheels 30,31, respectively. N represents the point at which the opposed teeth 32,33 on the upper and lower guide wheels 30,31 are nearest to each other.

Figure 3:
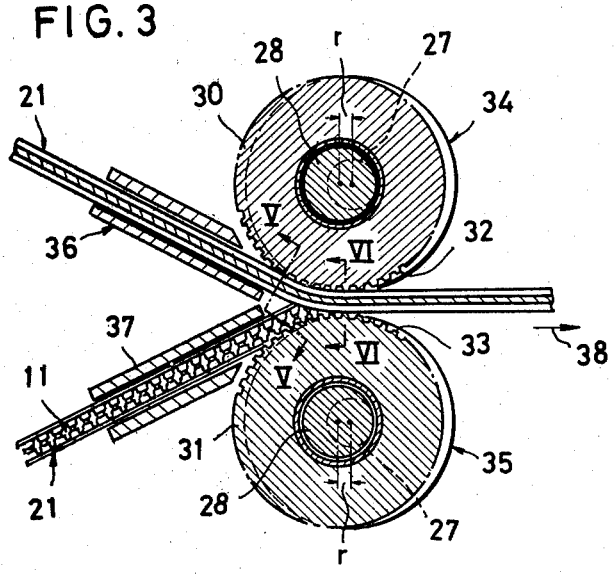
FIG. 3 is an enlarged cross-sectional view taken along line III—III of FIG. 1.
Figure 4:
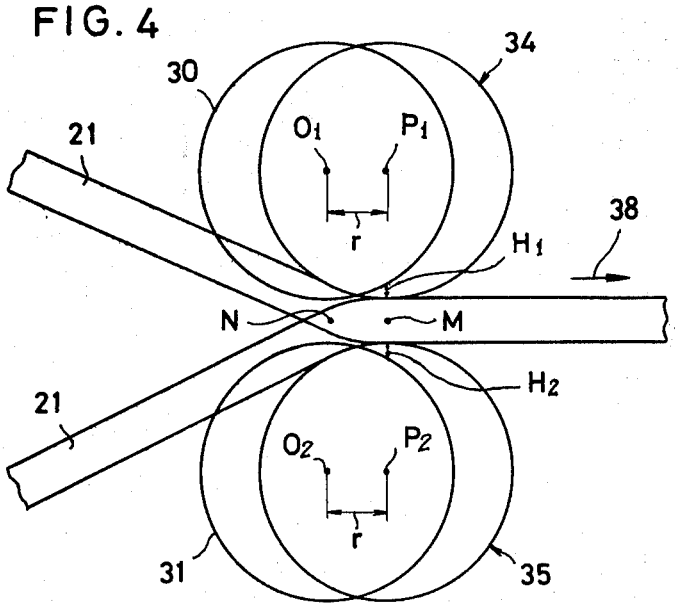
FIG. 4 is a diagrammatic view of the pairing apparatus, illustrating its mode of operation.

With this arrangement, the unengaged rows of coupling elements 11,11 introduced into the pairing apparatus 22 from the inlet side thereof, are first brought into engagement with the peripheral teeth 32,33 of the guide wheels 30,31, respectively, (FIG. 5) thereby regulating the distances between adjacent coupling elements of each row. Immediately after being released from the guide wheels 30,31, the pair of rows of coupling elements 11,11 are squeezed by the presser rollers 34,35. Accordingly, the pair of rows of coupling elements 11,11 are interengaged or mated nicely without obstruction or impairment by the wheel teeth 32,33 (FIG. 6) but while such regulated distances between adjacent coupling elements of each row remain. During this pairing operation, the pair of continuous slide fastener stringers 21,21 are moving in the direction of the arrow 38 (FIGS. 1 and 3). Designated at 40 are a pair of guide rolls, only one of which is shown here.

In order to facilitate the introduction of the unengaged rows of coupling elements 11,11 into the pairing apparatus 22, a pair of first and second guide members 36,37 (FIGS. 1 and 3) may be provided on the inlet side of the apparatus 22. The first and second guide members 36,37 are angularly spaced by a predetermined angle from each other (as viewed in side elevation) with their inner margins slightly overlapped (as viewed in plan), so that the pair of rows of coupling elements 11,11 can be directed tangentially toward the upper and lower guide wheels 30,31, respectively.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for interengaging a pair of rows of slide fastener coupling elements carried on a pair of stringer tapes, respectively, said apparatus comprising;

(a) a pair of non-rotatably supported parallel spaced first and second shafts, each of said first and second shafts having first and second portions eccentric to each other;

(b) a pair of guide wheels each rotatably mounted on said second portion of one of said first and second shafts and having a plurality of peripheral teeth meshable with one of unengaged rows of coupling elements for guiding the same and for regulating distances between adjacent coupling elements of the last-named one of unengaged rows; and (c) a pair of presser rollers each rotatably mounted on said first portion of one of said first and second shafts for squeezing the unengaged rows of coupling elements to interengage the same immediately after the latter are released from said peripheral teeth of said guide wheels, whereby the pair of rows of coupling elements can be interengaged without obstruction or impairment by said peripheral teeth of said guide wheels but while such regulated distances between adjacent coupling elements of each row remain.

2. An apparatus according to claim 1, each of said presser rollers comprising a pair of roller sections disposed one on each side of said guide wheel on one of said first and second shafts, each of said roller sections on said first shaft being cooperative with one of said roller sections on said second shaft to squeeze one of the unengaged rows of coupling elements therebetween.

3. An apparatus according to claim 2, each of such four roller sections having a recessed portion extending along an inner perpheral edge thereof for receiving a portion of one of the pair of rows of coupling elements.

4. An apparatus according to claim 1, including a pair of inlet guides angularly spaced from each other for guiding the pair of stringer tapes with the unengaged rows of coupling elements such that the latter are directed tangentially toward said first and second guide wheels, respectively.

* * * * *